US008300001B2

(12) United States Patent
Han et al.

(10) Patent No.: US 8,300,001 B2
(45) Date of Patent: Oct. 30, 2012

(54) DEMULTIPLEXER DRIVE CIRCUIT

(75) Inventors: Hsi-Rong Han, Tai Chung County (TW); Chien-Ting Chan, Chang Hua County (TW)

(73) Assignee: Wintek Corporation, Taichung (TW)

( * ) Notice: Subject to any disclaimer, the term of this patent is extended or adjusted under 35 U.S.C. 154(b) by 911 days.

(21) Appl. No.: 12/389,066

(22) Filed: Feb. 19, 2009

(65) Prior Publication Data

US 2009/0207119 A1 Aug. 20, 2009

(30) Foreign Application Priority Data

Feb. 19, 2008 (TW) ..... 97105672 A

(51) Int. Cl.
*G09G 3/36* (2006.01)

(52) U.S. Cl. ..... 345/98

(58) Field of Classification Search ..... 345/100, 345/98

See application file for complete search history.

(56) References Cited

U.S. PATENT DOCUMENTS

| | | | | |
|---|---|---|---|---|
| 7,173,600 | B2 | 2/2007 | Kodate et al. | |
| 2003/0179164 | A1 * | 9/2003 | Shin et al. | 345/76 |
| 2005/0134545 | A1 | 6/2005 | Jang et al. | |
| 2006/0107143 | A1 * | 5/2006 | Kim et al. | 714/726 |
| 2007/0018940 | A1 * | 1/2007 | Park | 345/100 |

FOREIGN PATENT DOCUMENTS

| | | |
|---|---|---|
| TW | 535135 | 6/2003 |
| TW | I230369 | 4/2005 |
| TW | 200521913 | 5/2006 |

* cited by examiner

*Primary Examiner* — Quan-Zhen Wang
*Assistant Examiner* — Tony Davis
(74) *Attorney, Agent, or Firm* — Muncy, Geissler, Olds & Lowe, PLLC

(57) ABSTRACT

A demultiplexer drive circuit includes a first, a second, a third, a fourth, and a fifth switching devices. The first switching device is connected to the first and the second scan clock signals. The control terminal of the second switching device is connected to the first switching device, and the rest of its terminals are connected to the data line and a first pixel electrode. The control terminal of the third switching device is connected to the first switching device, and the rest of its terminals are connected to the data line and a second pixel electrode. The fourth switching device is connected to the first and the second scan clock signals and its control terminal is connected to the third switching device. The control terminal of the fifth switching device is connected to the fourth switching device, and the rest of its terminals are connected to the data line and a third pixel electrode. The first scan clock signal and the second scan clock signal have a substantially identical pulse width and a phase difference of substantially half of the pulse width.

16 Claims, 4 Drawing Sheets

DEMULTIPLEXER DRIVE CIRCUIT

CROSS REFERENCE TO RELATED APPLICATION

This application claims priority of application No. 097105672 filed in Taiwan R.O.C on Feb. 19, 2008 under 35 U.S.C. §119; the entire contents of which are hereby incorporated by reference.

BACKGROUND OF THE INVENTION

1. Field of the Invention

The invention relates to a demultiplexer drive circuit, particularly to a demultiplexer drive circuit capable of sharing a same data line to write pixel data into different pixels in a time-division manner.

2. Description of the Related Art

FIG. 1 shows an equivalent circuit diagram of a partial pixel of a conventional liquid crystal display (LCD) 100. Referring to FIG. 1, the LCD 100 has multiple gate lines G1-Gn and data lines D1-Dm that are intersected with each other. Each intersection is provided with a first thin film transistor LTFT1 and a second thin film transistor LTFT2 that control a pixel PL in the left side of one data line and a third thin film transistor RTFT that controls a pixel PR in the right side of the data line. Thereby, pixel data transmitted from a same data line are fed into the left pixel PL and the right pixel PR. Hence, the above circuitry together with time-division control over gate drive signals allows the pixel data transmitted from a same data line to be alternately fed into the left pixel PL and the right pixel PR to save half data lines.

However, though the above design may achieve the effect of reducing the number of data lines, the time-divisional control over gate drive signals and the data transmission achieved by a data IC are too complicated. Further, there is still more room for reducing the number of data lines.

BRIEF SUMMARY OF THE INVENTION

The invention relates to a demultiplexer drive circuit, particularly to a demultiplexer drive circuit capable of sharing a same data line to write pixel data into different pixels in a time-division manner.

According to an embodiment of the invention, a demultiplexer drive circuit is used in a liquid crystal display for receiving a first and a second scan clock signals and writing pixel data transmitted from a same data line into different pixels in a time-division manner. The demultiplexer drive circuit includes a first, a second, a third, a fourth, and a fifth switching devices. The first switching device is connected to the first and the second scan clock signals. The control terminal of the second switching device is connected to the first switching device, and the rest of its terminals are connected to the data line and a first pixel electrode. The control terminal of the third switching device is connected to the first switching device, and the rest of its terminals are connected to the data line and a second pixel electrode. The fourth switching device is connected to the first and the second scan clock signals and its control terminal is connected to the third switching device. The control terminal of the fifth switching device is connected to the fourth switching device, and the rest of its terminals are connected to the data line and a third pixel electrode. The first scan clock signal and the second scan clock signal have a substantially identical pulse width and a phase difference of substantially half of the pulse width.

In one embodiment, the first switching device is a first PMOS transistor, the second switching device is a first NMOS transistor, the third switching device is a second NMOS transistor, the fourth switching device is a third NMOS transistor, and the fifth switching device is a fourth NMOS transistor. The sources of the first NMOS transistor, the second NMOS transistor and the fourth NMOS transistor are connected to the data line to allow the pixel data transmitted from the data line to be written into the pixels when the first, the second and the fourth NMOS transistors are turned on.

In one embodiment, the first switching device is a first NMOS transistor, the second switching device is a first PMOS transistor, the third switching device is a second PMOS transistor, the fourth switching device is a third PMOS transistor, and the fifth switching device is a fourth PMOS transistor. The sources of the first PMOS transistor, the second PMOS transistor, and the fourth PMOS transistor are connected to the data line to allow the pixel data transmitted from the data line to be written into the pixels when the first, the second and the fourth PMOS transistors are turned on.

According to the above embodiments, a same data line may transmit pixel data into three different pixels (such as a red pixel, a blue pixel and a green pixel) in a time-division manner to reduce the number of data lines to one-third of the data lines used in a conventional design. Further, during the process of writing pixel data into pixels, the same pixel data are meanwhile written into another pixel except for a target pixel. Thus, the pixel is pre-charged and needs less time to be written into exact pixel data.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

FIG. 4 shows a waveform diagram of different scan clock signals for illustrating the operation of the demultiplexer drive circuit.

DETAILED DESCRIPTION OF THE INVENTION

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and variations thereof herein are used broadly and encompass direct and indirect connections, couplings, and mountings. Similarly, "adjacent to" and variations thereof herein are used broadly and encompass directly and indirectly "adjacent to". Therefore, the description of "A" component "adjacent to" "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
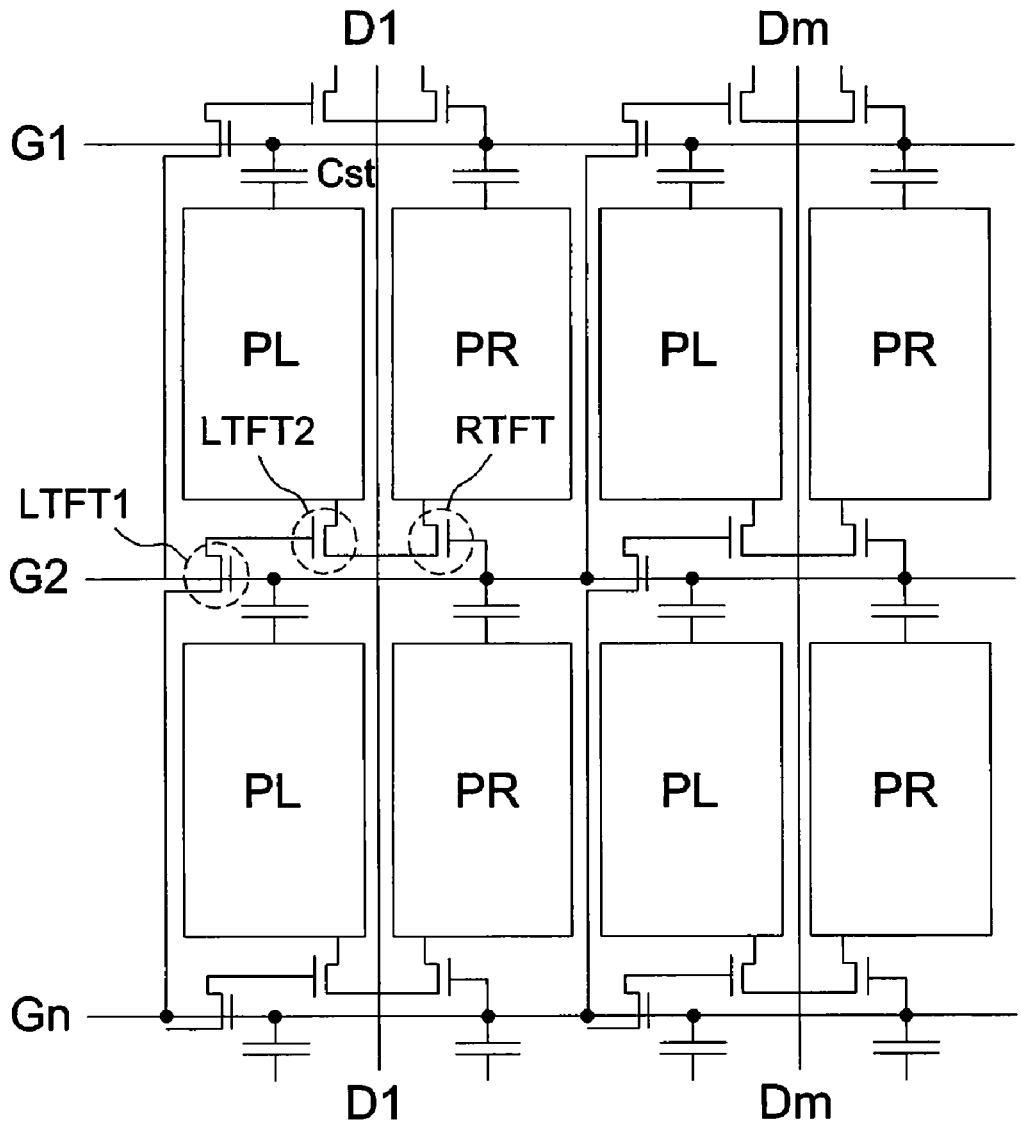
FIG. 1 (Prior Art)
FIG. 1 shows an equivalent circuit diagram of a partial pixel of a conventional liquid crystal display.
Figure 2:
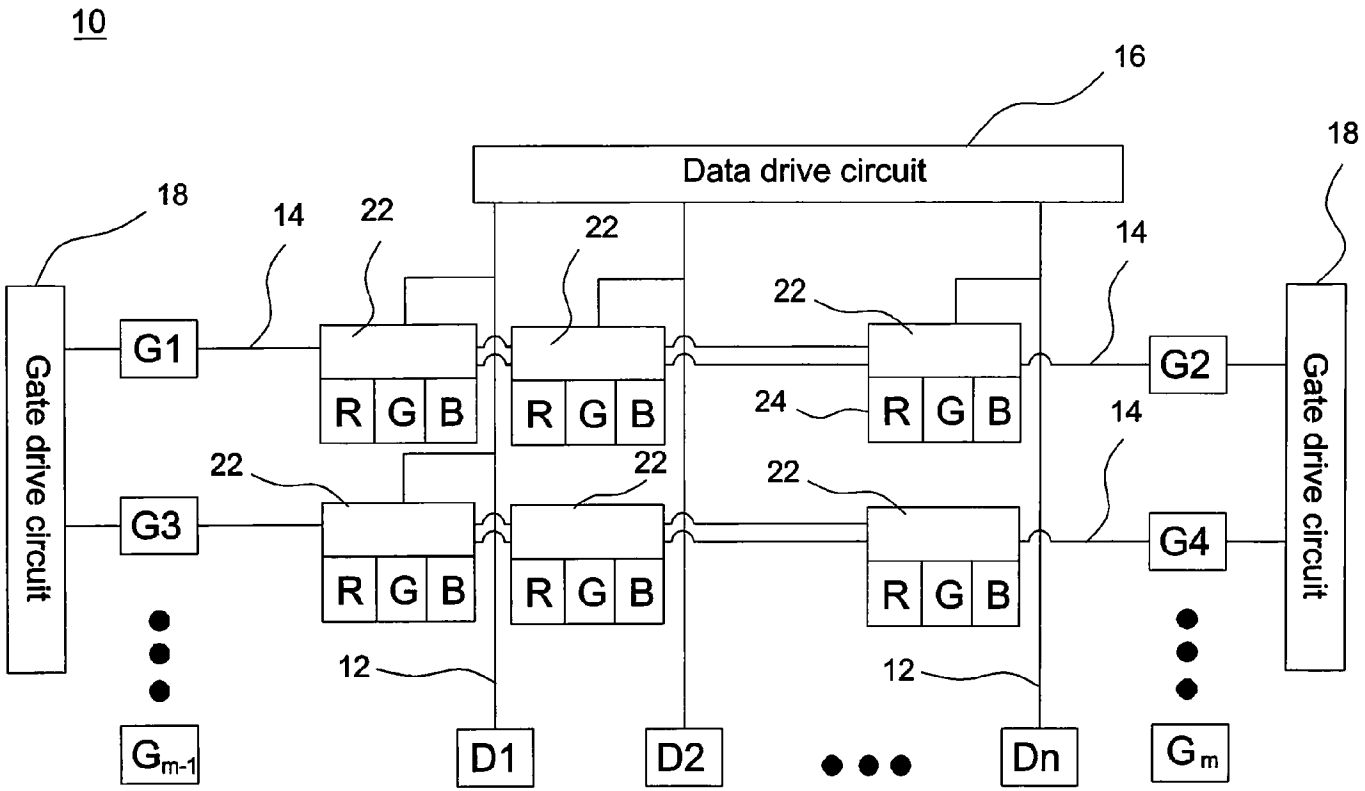
FIG. 2 shows a schematic diagram illustrating an LCD according to an embodiment of the invention.

FIG. 2 shows a schematic diagram illustrating an LCD 10 according to an embodiment of the invention. Referring to FIG. 2, the LCD 10 has multiple data lines 12 (D1-Dn; n is a positive integer) and multiple gate lines 14 (G1-Gm; m is a positive integer). A data drive circuit 16 transmits pixel data to the data lines 12; specifically, the data drive circuit 16 locks digital video signals, converts them into analog γ voltage levels, and then transmits them into data lines D1-Dn. A gate drive circuit 18 transmits scan clock signals into gate lines G1-Gm in succession.

According to this embodiment, multiple red pixels 24R, green pixels 24G, and blue pixels 24B are arranged into multiple rows of pixel units, and each row of pixel units is controlled by two gate lines 14. For example, a first row of pixel units is connected to gate lines G1 and G2, a second row of pixel units is connected to gate lines G3 and G4, and all others are similarly situated. The LCD 10 has multiple demultiplexer drive circuits 22, and each demultiplexer drive circuit 22 corresponds to a red pixel 24R, a green pixel 24G, and a blue pixel 24B.

Figure 3:
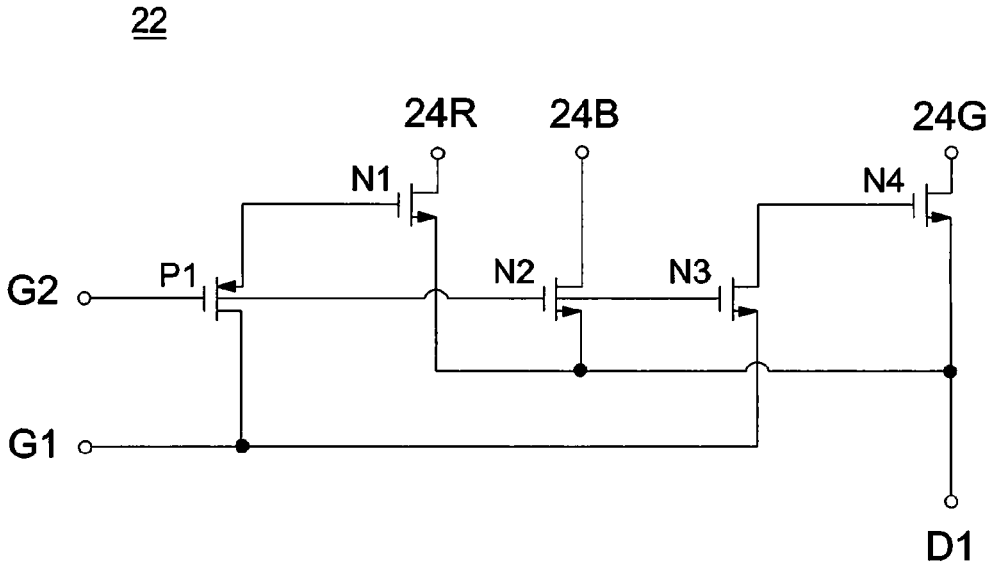
FIG. 3 shows an equivalent circuit diagram of a demultiplexer drive circuit according to an embodiment of the invention.
Figure 4:
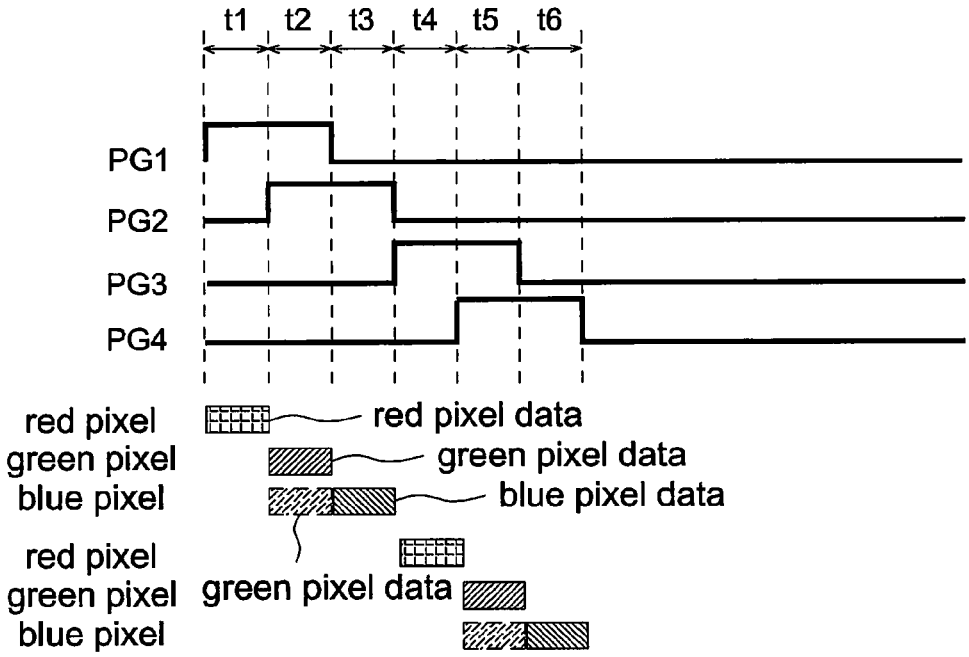
FIG. 4 shows a waveform diagram of scan clock signals fed into the demultiplexer drive circuit shown in FIG. 3.

FIG. 3 shows an equivalent circuit diagram of a demultiplexer drive circuit according to an embodiment of the invention, and FIG. 4 shows a waveform diagram of scan clock signals fed into the demultiplexer drive circuit shown in FIG. 3. Referring to FIG. 3, the demultiplexer drive circuit 22 includes a first PMOS transistor P1, a first NMOS transistor N1, a second NMOS transistor N2, a third NMOS transistor N3, and a fourth NMOS transistor N4. The drains of the first NMOS transistor N1, the second NMOS transistor N2 and the fourth NMOS transistor N4 are respectively connected to the pixel electrodes of a red pixel 24R, a blue pixel 24B, and a green pixel 24G. The sources of the first NMOS transistor N1, the second NMOS transistor N2, and the fourth NMOS transistor are connected to a same data line D1. Hence, the pixel data transmitted from the data line D1 are written into the red pixel 24R as the first NMOS transistor N1 is turned on, written into the blue pixel 24B as the second NMOS transistor N2 is turned on, and written into the green pixel 24G as the fourth NMOS transistor N4 is turned on. The first gate line G1 that transmits a first scan clock signal PG1 is connected to the drain of the first PMOS transistor P1 and the source of the third NMOS transistor N3. The second gate line G2 that transmits a second scan clock signal PG2 is connected to the gates (control terminals) of the first PMOS transistor P1, the second NMOS transistor N2, and the third NMOS transistor N3.

FIG. 4 shows a waveform diagram of different scan clock signals PG1 and PG2 for illustrating the operation of the demultiplexer drive circuit 22, where the first scan clock signal PG1 and the second scan clock signal PG2 have a substantially identical pulse width and a phase difference of substantially half of the pulse width.

1. Time Interval t1

During the time interval t1, the scan clock signal PG1 is in a high level and the scan clock signal PG2 is in a low level, so the first PMOS transistor P1 is turned on. When the first PMOS transistor P1 is turned on, the first NMOS transistor N1 is also turned on since the gate (control terminal) of the first NMOS transistor N1 is connected to the source of the first PMOS transistor P1. Besides, since the gate of the second NMOS transistor N2 is connected to the scan clock signal PG2 having a low level, the second NMOS transistor N2 is turned off, and the third NMOS transistor N3 whose gate is connected to the gate of the second NMOS transistor N2 is also turned off. When the third NMOS transistor N3 is turned off, the fourth NMOS transistor N4 whose gate is connected to the drain of the third NMOS transistor N3 is also turned off. Hence, during the time interval t1, red pixel data transmitted from the data line D1 are written into the red pixel 24R since the first NMOS transistor N1 is turned on.

2. Time Interval t2

During time interval t2, the scan clock signals PG1 and PG2 are in a high level, so the first PMOS transistor P1 is turned off. When the first PMOS transistor P1 is turned off, the first NMOS transistor N1 whose gate is connected to the source of the first PMOS transistor P1 is also turned off. Besides, since the gate of the second NMOS transistor N2 is connected to the scan clock signal PG2 having a high level, the second NMOS transistor N2 is turned on. Further, the third NMOS transistor N3 whose gate is connected to the gate of the second NMOS transistor is also turned on. When the third NMOS transistor N3 is turned on, the fourth NMOS transistor N4 whose gate is connected to the drain of the third NMOS transistor N3 is also turned on. During the time interval t2, since the fourth NMOS transistor N4 is turned on, green pixel data transmitted from the data line D1 are written into the green pixel 24G; meanwhile, since the second NMOS transistor N2 is also turned on, the green pixel data transmitted from the data line D1 are also written into the blue pixel 24B to pre-charge the blue pixel 24B.

3. Time Interval t3

During the time interval t3, the scan clock signal PG1 is in a low level and the scan clock signal PG2 is in a high level, so the first PMOS transistor P1 is turned off. When the first PMOS transistor P1 is turned off, the first NMOS transistor N1 whose gate is connected to the source of the first PMOS transistor P1 is also turned off. Besides, the second NMOS transistor N2 whose gate is connected to the scan clock signal PG2 having a high level is turned on, and the third NMOS transistor whose gate is connected to the gate of the second NMOS transistor N2 is also turned on. When the third NMOS transistor N3 is turned on, the fourth NMOS transistor N4 whose gate is connected to the drain of the third NMOS transistor N3 is turned off since the third NMOS transistor N3 is connected to the scan clock signal PG1 having a low level. Hence, during the time interval t3, blue pixel data transmitted from the data line D1 are written into the blue pixel 24B when the second NMOS transistor N2 is turned on. In that case, since the blue pixel 24B has been pre-charged (through the previous writing of the green pixel data) during the previous time interval t2, the time required for writing exact blue pixel data into the blue pixel 24B during the current time interval t3 is considerably shortened.

Thereafter, another set of gate lines (such as a third gate line G3 and a fourth gate line G4) transmit pixel data into a succeeding data line (such as the data line D2) during time intervals t4, t5 and t6 in a similar manner. Hence, according to this embodiment, a same data line 12 may transmit pixel data into three different pixels (such as the red pixel 24R, the blue pixel 24B, and the green pixel 24G) in a time-division manner to reduce the number of data lines to one-third of the data lines used in a conventional design. Further, during the process of writing pixel data into pixels, the same pixel data are meanwhile written into another pixel except for a target pixel. Thus, the pixel is pre-charged and needs less time to be written into exact pixel data.

Figure 5:
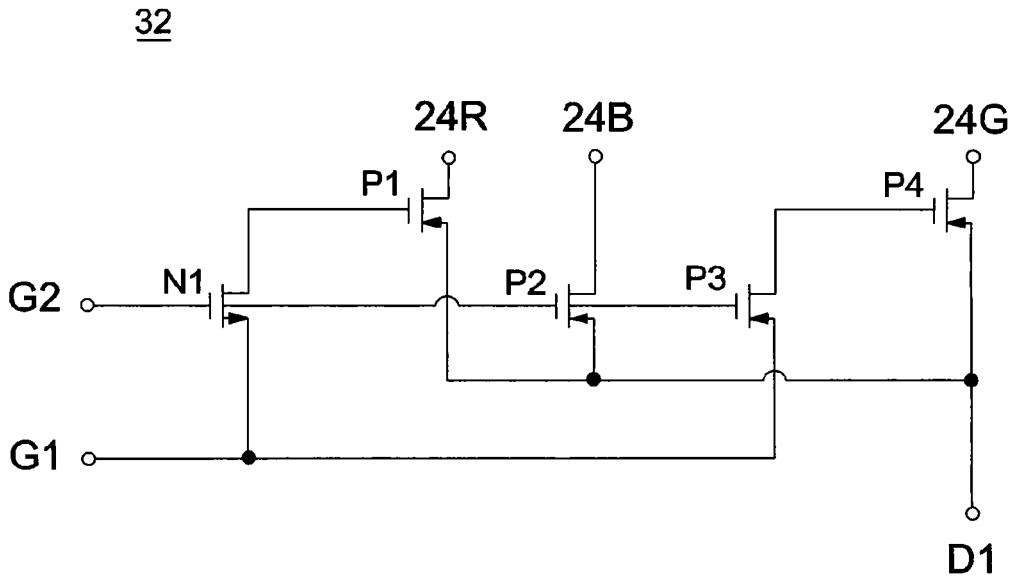
FIG. 5 shows an equivalent circuit diagram of another demultiplexer drive circuit according to an embodiment of the invention.
Figure 6:
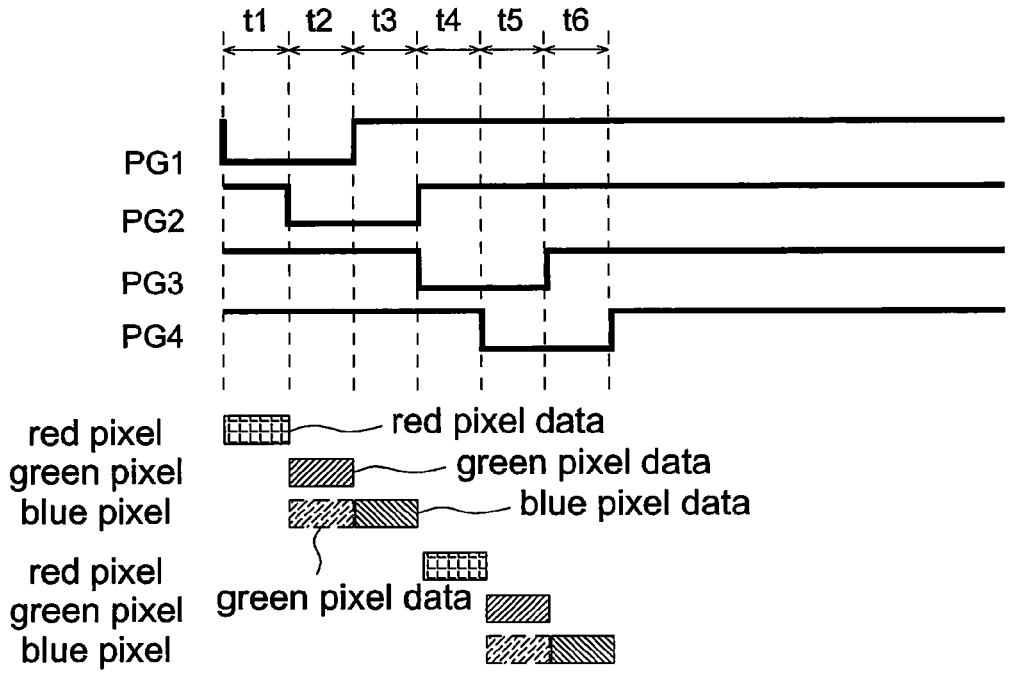
FIG. 6 shows a waveform diagram of scan clock signal fed into the demultiplexer drive circuit of FIG. 5.

FIG. 5 shows an equivalent circuit diagram of another demultiplexer drive circuit according to an embodiment of the invention, and FIG. 6 shows a waveform diagram of scan clock signal fed into the demultiplexer drive circuit of FIG. 5. Referring to FIG. 5, the demultiplexer drive circuit 32 includes a first NMOS transistor N1, a first PMOS transistor P1, a second PMOS transistor P2, a third PMOS transistor P3, and a fourth PMOS transistor P4. The drains of the first PMOS transistor P1, the second PMOS transistor P2, and the fourth PMOS transistor P4 are respectively connected to the pixel electrodes of a red pixel 24R, a blue pixel 24B and a green pixel 24G. Further, the sources of the first PMOS transistor P1, the second PMOS transistor P2, and the fourth PMOS transistor P4 are connected to a same data line D1. Hence, the pixel data transmitted from the data line D1 is written into the red pixel 24R as the first PMOS transistor P1 is turned on, written into the blue pixel 24B as the second PMOS transistor P2 is turned on, and written into the green pixel 24G as the fourth PMOS transistor P4 is turned on. The first gate line G1 that transmits a first scan clock signal PG1 is connected to the source of the first NMOS transistor N1 and the source of the third PMOS transistor P3. The second gate line G2 that transmits a second scan clock signal PG2 is connected to the gates (control terminals) of the first NMOS transistor N1, the second PMOS transistor P2 and the third PMOS transistor P3. This embodiment shown in FIG. 5 is similar to the embodiment shown in FIG. 3, except the NMOS transistors and the PMOS transistors are replaced with each other. Besides, the scan clock signals that trigger the demultiplexer drive circuit 32 are inverted in phase compared to the scan clock signals that trigger the demultiplexer drive circuit 22; that is, the sequence of high and low levels of each scan clock signal shown in FIG. 6 interchanges with that of each scan clock signal shown in FIG. 4. In that case, the on/off state of each transistor in this embodiment is the same as that of the transistor at a corresponding position shown in FIG. 3 to achieve the similar effect of reducing the number of data lines and pre-charging pixel voltage.

Further, note that the type and arrangement of pixels in all the above embodiments are merely used for exemplified purposes and thus are not limited.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A demultiplexer drive circuit used in a liquid crystal display having a plurality of pixels, wherein the pixels are arranged into multiple pixel rows and each of the pixel rows receives a first scan clock signal and a second scan clock signal, the demultiplexer drive circuit writing pixel data transmitted from a same data line into different pixels in a time-division manner, and comprising:

a first switching device connected to the first scan clock signal from a first gate line and the second scan clock signal from a second gate line;

a second switching device, its control terminal being connected to the first switching device and the rest of its terminals being connected to the data line and a first pixel electrode;

a third switching device, its control terminal being connected to the first switching device and the rest of its terminals being connected to the data line and a second pixel electrode;

a fourth switching device connected to the first scan clock signal from the first gate line and the second scan clock signal from the second gate line and its control terminal being connected to the third switching device; and a fifth switching device, its control terminal being connected to the fourth switching device and the rest of its terminals being connected to the data line and a third pixel electrode;

wherein the first scan clock signal and the second scan clock signal have a substantially identical pulse width and a phase difference of substantially half of the pulse width.

2. The demultiplexer drive circuit as claimed in claim 1, wherein the first, the second and the third pixel electrodes belong to a red, a blue and a green pixels, respectively.

3. The demultiplexer drive circuit as claimed in claim 1, wherein the first switching device is a first PMOS transistor, the second switching device is a first NMOS transistor, the third switching device is a second NMOS transistor, the fourth switching device is a third NMOS transistor, and the fifth switching device is a fourth NMOS transistor.

4. The demultiplexer drive circuit as claimed in claim 3, wherein the sources of the first NMOS transistor, the second NMOS transistor and the fourth NMOS transistor are connected to the data line to allow the pixel data transmitted from the data line to be written into the pixels when the first, the second and the fourth NMOS transistors are turned on.

5. The demultiplexer drive circuit as claimed in claim 4, wherein the first NMOS transistor is turned on and the second and the fourth NMOS transistors are turned off when the first scan clock signal is in a high level and the second scan clock signal is in a low level.

6. The demultiplexer drive circuit as claimed in claim 4, wherein the first NMOS transistor is turned off and the second and the fourth NMOS transistors are turned on when the first scan clock signal is in a high level and the second scan clock signal is in a high level.

7. The demultiplexer drive circuit as claimed in claim 4, wherein the first NMOS transistor is turned off, the second NMOS transistor is turned on, and the fourth NMOS transistor is turned off when the first scan clock signal is in a low level and the second scan clock signal is in a high level.

8. The demultiplexer drive circuit as claimed in claim 3, wherein the first scan clock signal is transmitted to the demultiplexer drive circuit through a first gate line, and the first gate line is connected to the drain of the first PMOS transistor and the source of the third NMOS transistor.

9. The demultiplexer drive circuit as claimed in claim 3, wherein the second scan clock signal is transmitted to the demultiplexer drive circuit through a second gate line, and the second gate line is connected to the gates of the first PMOS transistor, the second NMOS transistor, and the third NMOS transistor.

10. The demultiplexer drive circuit as claimed in claim 1, wherein the first switching device is a first NMOS transistor, the second switching device is a first PMOS transistor, the third switching device is a second PMOS transistor, the fourth switching device is a third PMOS transistor, and the fifth switching device is a fourth PMOS transistor.

11. The demultiplexer drive circuit as claimed in claim 10, wherein the sources of the first PMOS transistor, the second PMOS transistor, and the fourth PMOS transistor are connected to the data line to allow the pixel data transmitted from the data line to be written into the pixels when the first, the second and the fourth PMOS transistors are turned on.

12. The demultiplexer drive circuit as claimed in claim 11, wherein the first PMOS transistor is turned on and the second and the fourth PMOS transistors are turned off when the first scan clock signal is in a low level and the second scan clock signal is in a high level.

13. The demultiplexer drive circuit as claimed in claim 11, wherein the first PMOS transistor is turned off and the second and the fourth PMOS transistors are turned on when the first scan clock signal is in a low level and the second scan clock signal is in a low level.

14. The demultiplexer drive circuit as claimed in claim 11, wherein the first PMOS transistor is turned off, the second PMOS transistor is turned on, and the fourth PMOS transistor is turned off when the first scan clock signal is in a high level and the second scan clock signal is in a low level.

15. The demultiplexer drive circuit as claimed in claim 10, wherein the first scan clock signal is transmitted to the demultiplexer drive circuit through a first gate line, and the first gate line is connected to the source of the first NMOS transistor and the source of the third PMOS transistor.

16. The demultiplexer drive circuit as claimed in claim 10, wherein the second scan clock signal is transmitted to the demultiplexer drive circuit through a second gate line, and the second gate line is connected to the gates of the first NMOS transistor, the second PMOS transistor, and the third PMOS transistor.

* * * * *